US012520935B2

(12) United States Patent
Wickramasekera et al.

(10) Patent No.: US 12,520,935 B2
(45) Date of Patent: Jan. 13, 2026

(54) SLIDING BED TABLE

(71) Applicant: Outlier Campers LLC, Cambridge, MA (US)

(72) Inventors: Ananda Wickramasekera, Cambridge, MA (US); Mario Biscaro, Blainville (CA); Steeven Gilbert, Montreal (CA)

(73) Assignee: Outlier Campers LLC, Cambridge, MA (US)

( * ) Notice: Subject to any disclaimer, the term of this patent is extended or adjusted under 35 U.S.C. 154(b) by 90 days.

(21) Appl. No.: 18/639,463

(22) Filed: Apr. 18, 2024

(65) Prior Publication Data

US 2024/0349887 A1 Oct. 24, 2024

Related U.S. Application Data

(60) Provisional application No. 63/496,842, filed on Apr. 18, 2023.

(51) Int. Cl.

| | |
|---|---|
| ***A47B 23/00*** | (2006.01) |
| ***A47B 3/08*** | (2006.01) |
| ***A47B 9/00*** | (2006.01) |
| ***A47B 9/18*** | (2006.01) |
| ***A47B 23/02*** | (2006.01) |

(52) U.S. Cl.

CPC ..... *A47B 23/001* (2013.01); *A47B 3/08* (2013.01); *A47B 9/18* (2013.01); *A47B 23/025* (2013.01); *A47B 2003/0827* (2013.01); *A47B 2009/006* (2013.01)

(58) Field of Classification Search

CPC ..... A47B 23/001; A47B 3/08; A47B 9/18; A47B 2003/0827; A47B 2009/006; A47B 23/02; A47B 23/025

See application file for complete search history.

(56) References Cited

U.S. PATENT DOCUMENTS

| | | | | | |
|---|---|---|---|---|---|
| 2,452,160 | A * | 10/1948 | Smith | A47B 23/02 | 108/147.21 |
| 2,483,920 | A * | 10/1949 | Mclean | A47B 23/02 | 5/507.1 |
| 4,404,698 | A * | 9/1983 | Koncelik | A47B 23/02 | 297/153 |
| 11,406,182 | B1 * | 8/2022 | Stoddard | A47B 23/04 | |
| 2015/0296977 | A1 * | 10/2015 | Calderone | A47B 23/025 | 5/2.1 |
| 2018/0333838 | A1 * | 11/2018 | Cindric | A47B 3/08 | |
| 2024/0090658 | A1 * | 3/2024 | DeSpain | A47B 13/088 | |
| 2024/0349883 | A1 * | 10/2024 | Yang | A47B 3/091 | |

FOREIGN PATENT DOCUMENTS

| | | | | |
|---|---|---|---|---|
| CN | 203801983 | | 9/2014 | |
| CN | 208590631 | | 3/2019 | |
| CN | 208676568 | | 4/2019 | |
| CN | 209003093 | | 6/2019 | |
| CN | 111388225 | A * | 7/2020 | A47B 23/025 |
| CN | 112806768 | | 5/2021 | |
| CN | 214072316 | | 8/2021 | |
| CN | 116725337 | A * | 9/2023 | A47C 20/027 |

* cited by examiner

*Primary Examiner* — Daniel J Rohrhoff

(74) *Attorney, Agent, or Firm* — Fox Rothschild LLP

(57) ABSTRACT

Provided is a sliding and folding bed table with adjustable height, designed for use over beds in confined living spaces such as campers, camping trailers, RVs, rooftop tents, and similar environments. This table is particularly useful in areas where room around the bed is limited or where the bed is positioned close to the floor.

20 Claims, 6 Drawing Sheets

SLIDING BED TABLE

CROSS-REFERENCE TO RELATED APPLICATIONS

The entire contents of the following patent application are incorporated by reference herein: U.S. Provisional patent application Ser. No. 63/496,842; filed Apr. 18, 2023; and entitled SLIDING BED TABLE.

BACKGROUND

Technical Field

This invention pertains to the field of adjustable sliding bed table designed for use in confined spaces such as campers, camping trailers, recreational vehicles (RVs), rooftop tents, and similar environments. The table features a versatile and compact design with adjustable and foldable legs, aimed at optimizing space utilization and providing functionality in limited or uniquely arranged living areas.

Background

Campers, camping trailers, travel trailers, teardrop trailers, roof top tents, roof top campers, caravans, recreational vehicles, van conversions, tiny homes, other small dwellings, and any similar or equivalent objects collectively referred to as "campers" herein often have limited space around beds or mattresses and often have limited height above the mattress or have mattresses positioned close to the floor. For campers that do not have separate dinettes or separate places to sit and eat, it is often good to have a stowable table that can go on or above the mattress for use as a bed tray table to eat, work, play (e.g., play a game of cards or other games), or for other purposes a table may be typically used for. Compact bed tray tables currently available often come in dimensions just big enough to fit over one person's lap, for use by one person, and sometimes have legs that are placed directly on the mattress.

Although, these are often compact enough to be used and stored inside campers with limited space, placement directly on a mattress for use is less stable than tables that are placed directly on the floor, on either side of the bed, or attached to a wall. When a person moves, the tray table is likely to move, and the table is more prone to accidental tipping over. The compact bed tray tables cannot often be used on the bed for storage while a person is sleeping, because they don't often have the height to accommodate anyone sleeping under it and could accidentally be kicked or hit and tipped over during sleep. Campers often have limited space to place objects around the bed or for a person to maneuver on the mattress to either exit or enter the camper or for any other reason, requiring either moving the table to a different location on the bed, with items on it or after having removed items from it, or folding it and temporarily storing it. Tables that span the full width or most of the width of the bed and that have legs that extend to the floor, such that the table straddles the bed over which it is used, are more stable, allow for easier positioning and repositioning of the table but are often too tall, too wide, or too bulky for use in compact campers. Often mattresses in campers will take up the entire floor space of the camper, such as in rooftop tents, rooftop campers, teardrop trailers, and other compact travel trailers. Even if there is extra length beyond the mattress in some campers, the mattress often takes up most of the width from wall to wall. In many cases, door handles on camper doors, light fixtures, storage nets, or other attachments fixed to the camper walls may extend a bit into the space above a mattress. In campers without standing or full height or in campers with full height but that have the beds on elevated platforms to offer storage below, the mattresses are often placed close to or on the camper floor or an elevated platform, limiting height above the mattress.

Limited space around or above the mattress makes using typical, full-width bed tables that go over the bed difficult or impossible for use in some campers. And if the mattress is placed directly on the floor or on an elevated platform typical, full-width bed tables may have heights that are too tall for use as a tray table, since the tabletop will be far above a person's lap. Even in a camper with a bed placed at a typical height for a bed from the floor and ceiling (e.g., a normal bed height in a home with normal height ceilings) such that the full-width bed table is positioned at a typical tray table height above the bed, a full-width bed table may also not be left in place nor used for storage above the bed during sleep because either there is insufficient room below to comfortably sleep under it or, since it is not fixed, it may still be tipped over by a person accidentally kicking or hitting it during sleep or at other times. Since smaller, folding tray tables can be cumbersome to use in campers with limited floor space, offer limited table surface area, and often can't be used for storage on or over beds; and over-the-bed tray tables can be too wide and/or tall for campers with limited height and/or width, or when mattress are placed on the floor, and also can't be used for storage on or over beds there are no good options for tables that: allow for easy entry, exit, or maneuvering on or around the bed; have features that prevent accidental tipping; have various heights for use as a tray table or a storage shelf; and maximize the usable width above a mattress without interfering with camper walls or protrusions on camper walls, other than the sliding bed table described herein.

Other objectives or solutions to deficiencies are also contemplated.

SUMMARY

The rails or other, similar guides such as trenches, tracks, grooves, and/or slots that form a guided pathway of the sliding bed table may be installed close to the sides of the mattress, or possibly even under or compressing it, and with the slightly slanted legs of the table, the sliding bed table may be narrow enough to avoid interference with camper door handles or other wall/door attachments or protrusions. The rails or other guides and components of the rails or other guides, such as the sliders attached to them, may prevent accidental tipping of the table and allow for easier, guided sliding of the table to various positions for various purposes. The sliding bed table may extend most of the width of the mattress, offering substantial table or shelf surface area, however the slanted leg design slopes the legs toward the mattress so that the table legs and tabletop provide clearance for the camper walls and/or objects protruding from the walls. The sliding bed table may have two sets of legs—one for tray table height, positioning the table closer to a person's lap, and one for storage height, positioning the table high enough that it may not interfere with people sleeping below—and either set may be quickly folded or unfolded to change the height of the table or for storage. A latching mechanism and/or a method or mechanism of holding the table legs or feet captive until and unless released to keep the table legs securely attached to the rail or other guide and/or slider assembly may prevent accidental tipping and may allow the table to be quickly attached, quickly detached, or quickly convert between tray table and storage shelf and vice versa. The sliding bed table may allow attachment of a useful tray table, storage system, and/or extra sleeping surface (e.g., by supporting another mattress) to most campers with a rigid floor or platform below the mattress that the rails or other guides may be screwed into or otherwise fixed to that is more suitable for confined spaces and offers more features than existing tray tables. The sliding bed table's only required permanent or semi-permanent fixed points to a camper may be where the rails or other guides attach to the floor or mattress platform, allowing the sliding bed table to even be fixable to rooftop tents that have rigid floors but fabric walls, significantly improving the usability and functionality of rooftop tents. As mentioned above, other types of guides that may guide the movement of the sliding table along a fixed path while holding the table captive until and unless released may include trenches, slots, or grooves carved, cut, or molded into new or existing camper floors or mattress platforms.

A sliding bed table that: 1) has two or more pairs of folding legs with different heights, has one pair of adjustable height folding legs, or has one set of legs at a fixed height; 2) has dual, fixed or permanent guides that may be rails, tracks, trenches, and/or grooves that are secured to a floor or platform or are carved, cut, or molded into a floor or platform that a mattress (e.g., a mattress in a camper) may be placed on; 3) has sliders on each rail or other guide, capable of sliding along the rails or other guides and latching to the table legs or has sliding components or components capable of sliding that are part of the feet or legs of the table; 4) has quick release mechanisms or a method or mechanisms of holding the table legs captive until and unless released to quickly secure the table legs to the sliders or directly to the guides so that the table may slide along the guides without being accidentally tipped over and to quickly detach the table legs from the sliders and/or guides for storage or to change table legs, if equipped with two or more sets of tables legs; 5) does not extend substantially far or at all past the perimeter of the mattress to which it will be used over because the guides may be installed just to the sides or possibly even slightly under or compressing the mattress or may be inside the floor or platform and the legs may be slanted such that they may lean inward, toward the center of the mattress and away from the walls (e.g., camper walls on either immediate side of the mattress, if the camper is just wide enough to contain a mattress); and 6) stays in place, without unwanted movement, because the mattress may provide some resistance to unwanted movement and may require some light purposeful force to move the table, the sliders themselves may provide some resistance to unwanted movement, or the sliders may be locked in place to prevent unwanted movement is described herein.

A sliding bed table configured as a table with two or more pairs of folding legs attached to sliders on rails that may be configured to be almost as wide as a mattress (e.g., a twin-sized, full-sized, queen-sized, king-sized, or other custom or standard sized mattress in a camper) and may be used as either a tray table, a shelf, or in combination with another sliding bed table to form a larger surface. One pair of folding legs may be tall enough for the table to be used as a tray table that sits just above a person's lap while the person is sitting on a mattress (e.g., in a small camper). Another pair of folding legs may be taller and may allow the sliding bed table to be used as a storage shelf that provides sufficient space for a person to lay below it (e.g., in a sleeping position) on a mattress in a camper, particularly where the camper does not have additional storage space to the sides or at the ends of the mattress (as is the case in many rooftop tents, rooftop campers, and teardrop trailers). In either configuration—as a tray table or storage shelf—the sliding bed table may be able to slide easily, however not in an unwanted fashion, back and forth along its rails. For example, a person may wish to pull the table in its tray table configuration toward the middle or closer to the head of the bed, where a person may sit between it and the headboard or head of the bed and use it as a table for working (e.g., on a laptop), dining, playing games, or any other purpose. To exit or enter the camper, while the tray table is in place and even with objects on it, a person may need only to push or slide the table along its rails toward the foot of the bed, then exit or enter the camper, particularly where the camper door is close to the middle of the mattress, like in many rooftop tents, rooftop campers, teardrop trailers, and other smaller campers. In larger campers, where there is sufficient room on one or more sides of the bed, a person may be able to push or slide the table toward the foot of the bed to exit or enter the bed. The sliding bed table may be easily converted between tray table (i.e., shorter height) and shelf (i.e., taller height) configurations by disconnecting the table legs from the rail sliders, folding one pair of legs, unfolding another pair of legs, then reconnecting the table to the rail sliders. In shelf position, the sliding bed table can be slid toward the foot of the mattress or to whatever position is desired and used for storage. In the taller shelf position, the sliding bed table may provide sufficient height for a person to comfortably sleep under it (e.g., their feet might fit comfortably under the shelf or they may have enough space to turn and move around under the shelf). Alternatively, if the sliding bed table has one pair of adjustable height legs, the leg height may be adjusted to achieve different heights for different purposes. Or the sliding bed table may contain only one pair of legs for a fixed height. Alternatively to rails, the sliding bed table may have other guides that may be tracks, trenches, grooves, slots, and/or other guided pathways that may serve the same purpose as rails: to guide the sliding table along a fixed pathway while holding the table captive either inside or directly to the guides unless and until released from the guides, if directly attached to the guides, or attached to sliders on the guides unless and until released from the sliders on the guides.

To position the table for use, a person would unfold either pair of legs (for sliding bed tables that have more than one pair of legs), place the feet in and engage the quick-release pins into slots, notches, and/or holes in the slider of each rail. Once securely attached to the sliders, the sliding bed table may slide along its rails. In some cases, the legs, because they may be slanted toward the center of the mattress, or the sliders may touch and/or push against the sides of the mattress slightly, causing the mattress to provide some resistance against unwanted movement of the sliding bed table along the rails. To move the table in a purposeful manner, the pushing motion may cause either the slanted table legs and/or the sliders to rub against or slightly compress the mattress as they push past it, allowing for a more controlled movement of the table. Alternatively, the sliders themselves may contain resistance or locking mechanisms to control sliding or secure the sliders in a desired position on the rails. To remove the table for storage or to switch between table heights, the quick release pin may be disengaged to free the feet on each leg of the table from each rail's sliders.

Because the legs may be slanted toward the center of the mattress and away from the camper walls (e.g., in campers where the walls are close to the mattress on one or both sides) and because the tabletop may be slightly narrower than the mattress it is positioned for use above, the sliding bed table may avoid interference with camper walls or protrusions from campers walls, like door handles, switches, storage nets, etc., particularly as it slides along the length of the mattress. Since the table legs may fold relatively flat against the tabletop, the sliding bed table may be flat enough to be stored or positioned inside a collapsible camper, such as a rooftop tent, rooftop camper, or pop-up camper.

In some embodiments, a sliding bed table is provided. The sliding bed table includes a tabletop including a top surface and a bottom surface; a first pair of legs, each of the first pair of legs being hinged near each end of the bottom surface of the tabletop; a second pair of legs, each of the second pair of legs being hinged near each end of the bottom surface of the tabletop; and two guides. Each of the first pair of legs is transitionable between a first unfolded configuration and a first folded configuration. In the first unfolded configuration, each of the first pair of legs is unfolded until configured to be connected to the respective guide, In the first folded configuration, each of the first pair of legs is folded toward the bottom surface of the tabletop until resting relatively flat with the bottom surface of the tabletop. Each of the second pair of legs is transitionable between a second unfolded configuration and a second folded configuration. In the second unfolded configuration, each of the second pair of legs is unfolded until configured to be connected to the respective guide. In the second folded configuration, each of the second pair of legs is folded toward the bottom surface of the tabletop until resting relatively flat with the bottom surface of the tabletop.

Each of the first pair of legs may be height-adjustable. Each of the first pair of legs may be U-shaped.

In the first unfolded configuration, each of the first pair of legs may be unfolded to form an angle of about 90 degrees with the bottom surface of the tabletop. In the first unfolded configuration, each of the first pair of legs may be slanted inward or outward toward the bottom surface of the tabletop.

The sliding bed table may further comprise two sliders, each of which being associated with the respective guide, wherein each of the first pair of legs is configured to be connected to the respective slider that is configured to slidably move on the respective guide.

Each of the first pair of legs may include a connector that is configured to be received by the respective slider. The connector may be configured to be secured and detached by a mechanism of the respective slider. Preferably, the connector may be a pin and/or protrusion from the first pair of legs.

Similarly, each of the second pair of legs may be height-adjustable. Each of the second pair of legs may be U-shaped.

In the second unfolded configuration, each of the second pair of legs may be unfolded to form an angle of about 90 degrees with the bottom surface of the tabletop. In the second unfolded configuration, each of the second pair of legs may be slanted inward or outward toward the bottom surface of the tabletop.

The sliding bed table may further comprise two sliders, each of which being associated with the respective guide, wherein each of the second pair of legs is configured to be connected to the respective slider that is configured to slidably move on the respective guide. Each of the second pair of legs may include a connector that is configured to be received by the respective slider. The connector may be configured to be secured and detached by a mechanism of the respective slider.

Each of the first pair of legs may be positioned adjacent to the respective second pair of legs. Each of the first pair of legs in the first folded configuration are nested inside the respective second pair of legs in the second folded configuration.

In some embodiments, a sliding bed table is provided. The sliding bed table includes a tabletop including a top surface and a bottom surface; a first pair of legs, each of the first pair of legs being hinged near each end of the bottom surface of the tabletop; and two guides. Each of the first pair of legs is transitionable between a first unfolded configuration and a first folded configuration. In the first unfolded configuration, each of the first pair of legs is unfolded until configured to be connected to the respective guide, In the first folded configuration, each of the first pair of legs is folded toward the bottom surface of the tabletop until resting relatively flat with the bottom surface of the tabletop. In the first unfolded configuration, each of the first pair of legs is slanted inward or outward toward the bottom surface of the tabletop.

In some embodiments, a sliding bed table is provided. The sliding bed table includes a tabletop including a top surface and a bottom surface; a first pair of legs, each of the first pair of legs being hinged near each end of the bottom surface of the tabletop; and two guides connected to a camper. Each of the first pair of legs is transitionable between a first unfolded configuration and a first folded configuration. In the first unfolded configuration, each of the first pair of legs is unfolded until configured to be connected to the respective guide, In the first folded configuration, each of the first pair of legs is folded toward the bottom surface of the tabletop until resting relatively flat with the bottom surface of the tabletop.

BRIEF DESCRIPTION OF DRAWINGS

The nature and various advantages of the present invention will become more apparent upon consideration of the following detailed description, taken in conjunction with the accompanying drawings, in which like reference characters refer to like parts throughout, and in which.

Figure 1:
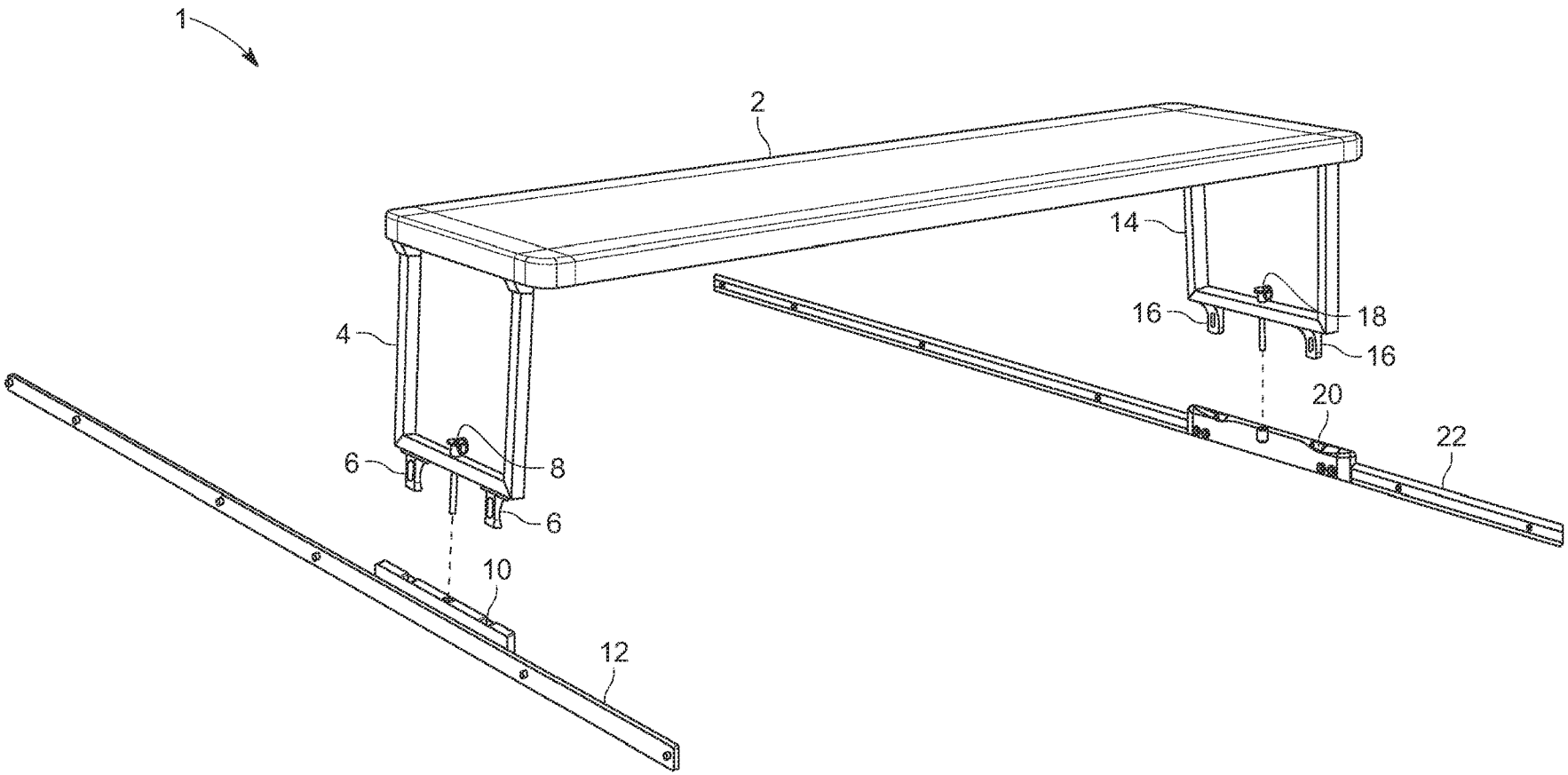
FIG. 1 shows a prospective view of an exemplary sliding bed table in accordance with one or more embodiments of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

As used herein, the term "campers" means campers, camping trailers, travel trailers, teardrop trailers, roof top tents, roof top campers, caravans, recreational vehicles, van conversions, tiny homes, other small dwellings, and any similar or equivalent objects.

As used herein, the term "about" means approximately or nearly and in the context of a numerical value or range set forth herein means 25% of the numerical value or range recited or claimed.

It would be beneficial for a bed table designed for confined spaces, such as those found in campers, to: be wide enough to maximize the usable area of the table; have folding legs for storage inside a camper; be capable of sliding along rails or guided pathways to various positions; be capable of easily and securely latching to fixed rails or other guides such that there is less chance of accidentally tipping over; be capable of various heights for use as a tray table closer to a person's lap or for use as a shelf at a comfortable distance above anyone sleeping below it; and have rails or other guides and sliders that are fixed or positioned close to the mattress or even with some or all portions just under it or compressing it and have legs that are slanted such that the table requires either no space or very little space around the mattress and may not interfere with camper walls or objects attached to the campers walls. It would further be beneficial if two or more bed tables can be combined for an even larger table surface, larger shelf surface, and/or to support a mattress on the table that may be wider than the depth of one table. A table that: 1) spans most of the width of a mattress above which it is used; 2) has folding legs so that they may be stored flat; 3) has legs that may be quickly latched, fixed, or otherwise secured to sliders on rails or other guides or directly to the guides so that the table may slide backward and forward and may be quickly detached for storage; 4) has multiple pairs of legs or has adjustable height legs to achieve various heights; and 5) may be combined with at least one other table to at least double the surface area of the table or shelf is described herein. Where space around a mattress, space to maneuver on or around a mattress, height above a mattress, and storage space both when a bed is being used and when it is not are all limited (e.g., inside a camper), a sliding bed table capable of: maximizing the usable width above a mattress yet not interfering with walls or protrusions from walls, folding, sliding securely along guides, and variable heights would be beneficial and is described herein.

Described herein are devices, components, assemblies, systems, methods, etc. for sliding bed tables. The description and accompanying figures, which describe and show certain embodiments, are made to demonstrate, in a non-limiting manner, several possible configurations of sliding bed tables, apparatuses, components, assemblies, systems, etc. and various methods of using them according to various aspects and features of the present disclosure. Accordingly, the disclosure is not limited to the specific embodiments described. Rather, the inventive principles associated with the embodiments described herein, including with respect to the apparatuses, devices, components, assemblies, systems, methods, etc. described herein, may be applied in a variety of ways, including to other types of apparatuses, devices, components, assemblies, systems, methods, etc. General and specific apparatuses, devices, components, assemblies, systems, methods, etc. are described herein sufficiently to enable one to develop a variety of implementations/applications without undue experimentation. In the development of particular applications, numerous implementation-specific decisions will be made to achieve the design-specific goals, which will vary from one implementation/application to another. It will be appreciated that, having access to this disclosure and reading this disclosure, such a development effort would be a routine undertaking for persons of ordinary skill in the art.

This document does not intend to distinguish between components that differ in name but not function. In the following discussion and in the claims, the terms "including," "includes," "comprising," "have," "has" and their derivatives are used in an open-ended fashion, and thus should be interpreted to mean "including, but not limited to." The word "or" is used in the inclusive sense (i.e., "and/or") unless a specific use to the contrary is explicitly stated.

Figure 2:
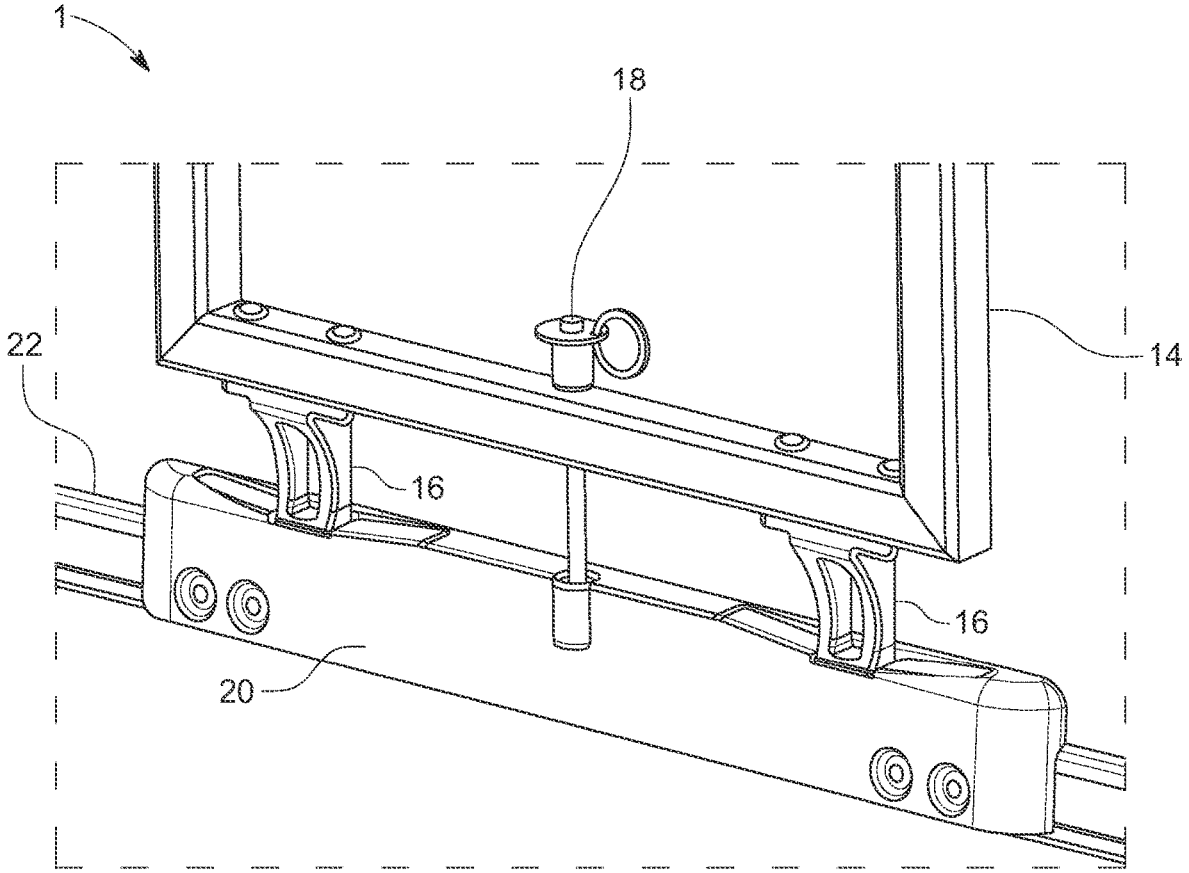
FIG. 2 shows a close-up prospective view of the feet and quick release pin of a leg attached to a slider in an exemplary sliding bed table in accordance with one or more embodiments of the present invention.

FIG. 1 shows a prospective view of exemplary sliding bed table 1, configured as a table with folding legs that latch to sliders on rails. Tabletop 2 may be a flat surface configured to span most of the width of a standard-size mattress (e.g., a Twin or Twin XL which may both be about 39 inches wide, give or take a few inches; Full or Full XL which may both be about 54 inches wide, give or take a few inches; Queen which may be about 60 inches wide, give or take a few inches; King which may be about 74 inches wide, give or take a few inches, or other standard size mattress) or a non-standard size mattress so that it may be used as a tray table when positioned at a shorter distance above a mattress or, when positioned at a taller height, as a storage shelf. Tabletop 2 may be one straight piece (e.g., a straight, flat surface that is not foldable) or it may be foldable (e.g., into two or more sections). Tabletop 2 may have a relatively flat surface on top and a supporting frame on its bottom surface, as shown later in FIG. 4, or it may be relatively flat across a top surface and have indentations along a bottom surface that may accommodate other components, such as folded legs, inside it or it may be a relatively flat surface across both the top and bottom surfaces with folded legs attached to its bottom surface. Tabletop 2 may be comprised of metal, wood, plastic, glass, a composite material, other suitable materials, or some combination of materials. Sliding bed table 1 may have two or more pairs of legs to position tabletop 2 at various heights for various purposes, or it may have one pair of legs with adjustable height, or it may have one pair of legs at a fixed height. As shown in FIG. 1, folding legs 4 and 14, which may be hingedly connected to a bottom surface of tabletop 2, are in an unfolded position at an angle slightly greater than 90 degrees relative to a bottom surface of tabletop 2 (as also shown later in FIG. 3) such that the legs are slanted inward, toward the center of the tabletop or center of a mattress (e.g., a mattress inside a camper, and slanted away from the camper walls) and feet 6 and 16 and pins 8 and 18 of legs 4 and 14, respectively, may be inserted into slots, notches, holes, and/or grooves in sliders 10 and 20, respectively, in rails 12 and 22, respectively. Feet 6 and 16 may be protrusions from legs 4 and 14, respectively, that fit into slots, notches, holes, and/or grooves in sliders 10 and 20, respectively, as shown in FIG. 1. Legs 4 and 14 may then be latched securely to sliders 10 and 20, respectively, by pins 8 and 18, respectively, such that they may not come loose unless the pins are unlatched or disengaged as also shown in FIG. 1. Pins 8 and 18 in legs 4 and 14, respectively, may each be a quick-release pin with a push button to latch or unlatch the pin, or may have some other type of quick attachment/detachment mechanism. Legs 4 and 14, and components of the legs such as feet 6 and 16, respectively, and pins 8 and 18, respectively, may each be comprised of metal, plastic, wood, rubber, a composite material, other suitable materials, or some combination of materials. Sliders 10 and 20 may be sliders that attach to rails 12 and 22, respectively. Sliders 10 and 20 may be attached to rails 12 and 22, respectively, by having wheels that fit on the rails or other guides or into slots in the rails or other guides or sliders 10 and 20 may have some other component that fits on or inside rails 12 and 22, respectively, such that the sliders may not come loose from the rails, in an unwanted fashion, but may still be able to slide along the rails, similar to many slider and rail assemblies commonly found. Alternatively, the feet may themselves have or be sliding mechanisms, such as wheels or other frictionless, low-friction, or other mechanisms capable of sliding along a guide, such as rails, tracks, trenches, grooves, or slots. Rails 12 and 22 may be rails, as shown, or they may be tracks, trenches, groves, slots, or other guided pathways that sliders 10 and 20, respectively, or sliding mechanisms attached directly to feet 6 and 16, respectively, or are feet 6 and 16, respectively, may attach to or into and held captive unless and until released. Sliders 10 and 20 and rails 12 and 22 may each be comprised of metal, wood, plastic, rubber, a composite material, other suitable materials, or some combination of materials. FIG. 2 shows a close-up prospective view of a leg of sliding bed table 1 inserted into a slider. In this case, as shown in FIG. 2, feet 16 of leg 14 are inserted into notches on slider 20 and securely latched in place by pin 18, which may be inserted into a hole or notch in slider 20 and held there securely until disengaged, such that the leg and slider assembly can move along rail 22. The leg, feet, pin, and slider on the other side of sliding bed table 1 or each leg, foot, and pin of another pair of legs, if so equipped and as discussed in more detail below, and a slider may be similarly connected. Secure attachment of legs 4 and 14 to sliders 10 and 20, respectively, may allow sliding bed table 1 to move along rails 12 and 22, backward and forward, along the length of the rails which may be equivalent to, less than, or greater than the length of a mattress (e.g., a mattress in a camper which may have a standard length of either 75 inches long, give or take a few inches, for standard-size Twin and Full mattresses or 80 inches long, give or take a few inches, for standard size Twin XL, Full XL, Queen, or King mattresses, or other standard or non-standard sized mattress). In some embodiments, legs such as feet 4 and 14 may be attached to sliders 10 and 20 without relying on feet 6 and 16 and pins 8 and 18, for example, by magnetic force. In some embodiments, feet 4 and 14 may be attached directly to rails 12 and 22, respectively, or other guides if they are themselves capable of sliding or have mechanisms such as wheels that enable them to slide.

Rails 12 and 22, as shown previously in FIG. 1, may be permanently (e.g., by nails, adhesive, or some other permanent fastening mechanism) or semi-permanently (e.g., by screws, thumb screws, wing nuts, or some other semi-permanent fastening mechanism) attached to a floor or mattress platform, positioned on either side of a mattress (e.g., a mattress inside a camper), as close to the mattress as possible or positioned in such a way that it slightly encroaches on the space occupied by the mattress. Alternatively rails 12 and 22 may be other guides, such as tracks, trenches, groves, and/or slots and may be fixed onto or into a floor or mattress platform as described above or may be carved, cut, or molded into the floor or mattress platform. The sliders, rails, and/or legs of sliding bed table 1 may slightly compress a mattress bound by it, if they're placed close enough to touch the mattress and/or placed slightly closer than the width of the mattress, such that the mattress is slightly compressed, providing some resistance to unwanted sliding of the table and some light purposeful force may be required to push or pull sliding table 1 along its rails. Alternatively, the sliders of sliding bed table 1 may provide some resistance or friction (that is either adjustable or not), by use of a screw, spring, brake, pads, wheels with friction (i.e., softer or rubber wheels, wheels that rub on the sides of the rails, or other types of wheels that provide some resistance), or by some other resistance mechanism, that may prevent movement, except through deliberate, light force, or alternatively, the sliders may have a lock or brake that may hold sliding table 1 in a fixed position unless disengaged.

Figure 3:
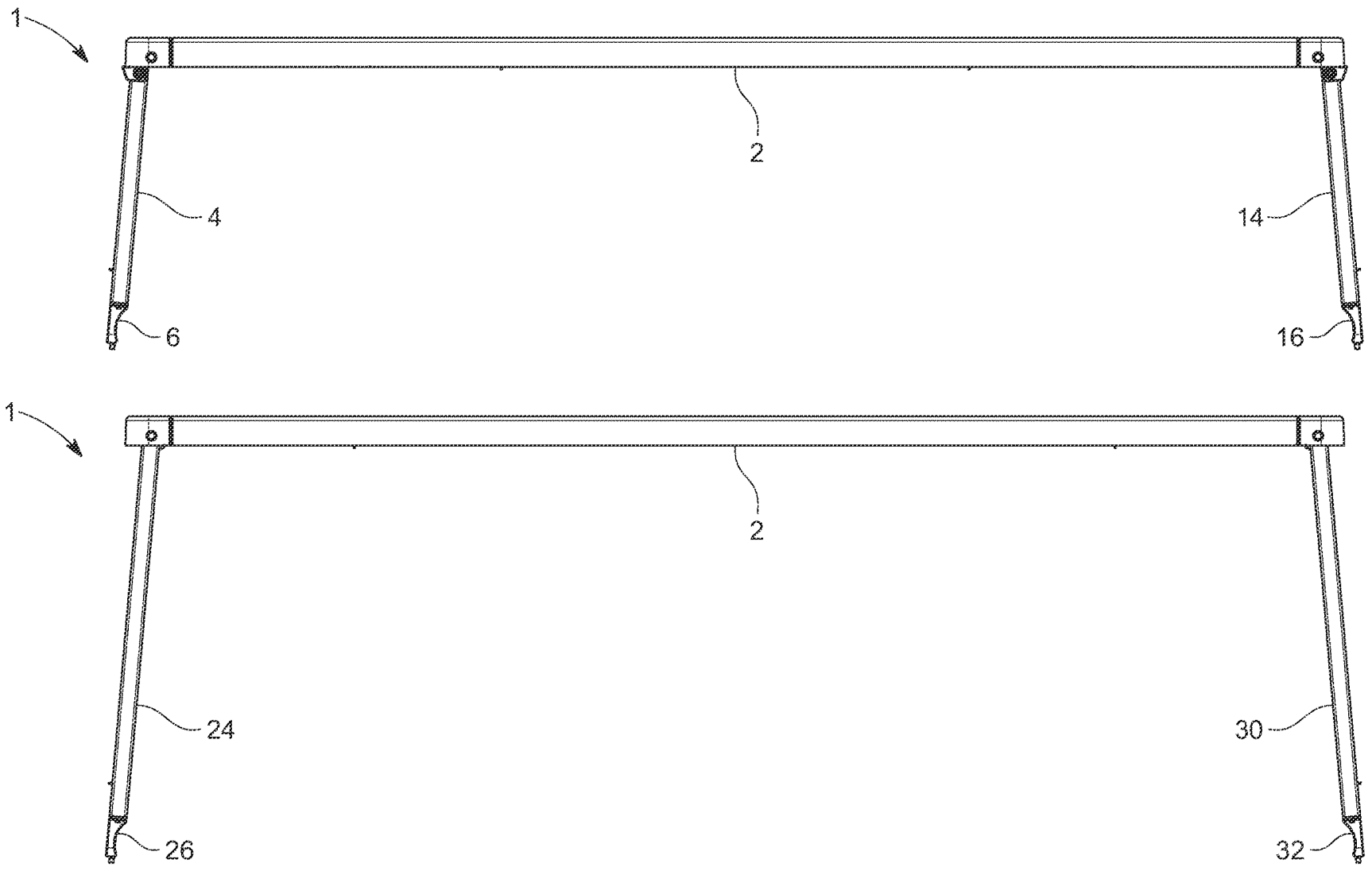
FIG. 3 shows a comparative, front prospective view of an exemplary sliding bed table in tray table configuration versus shelf configuration in accordance with one or more embodiments of the present invention.
Figure 4:
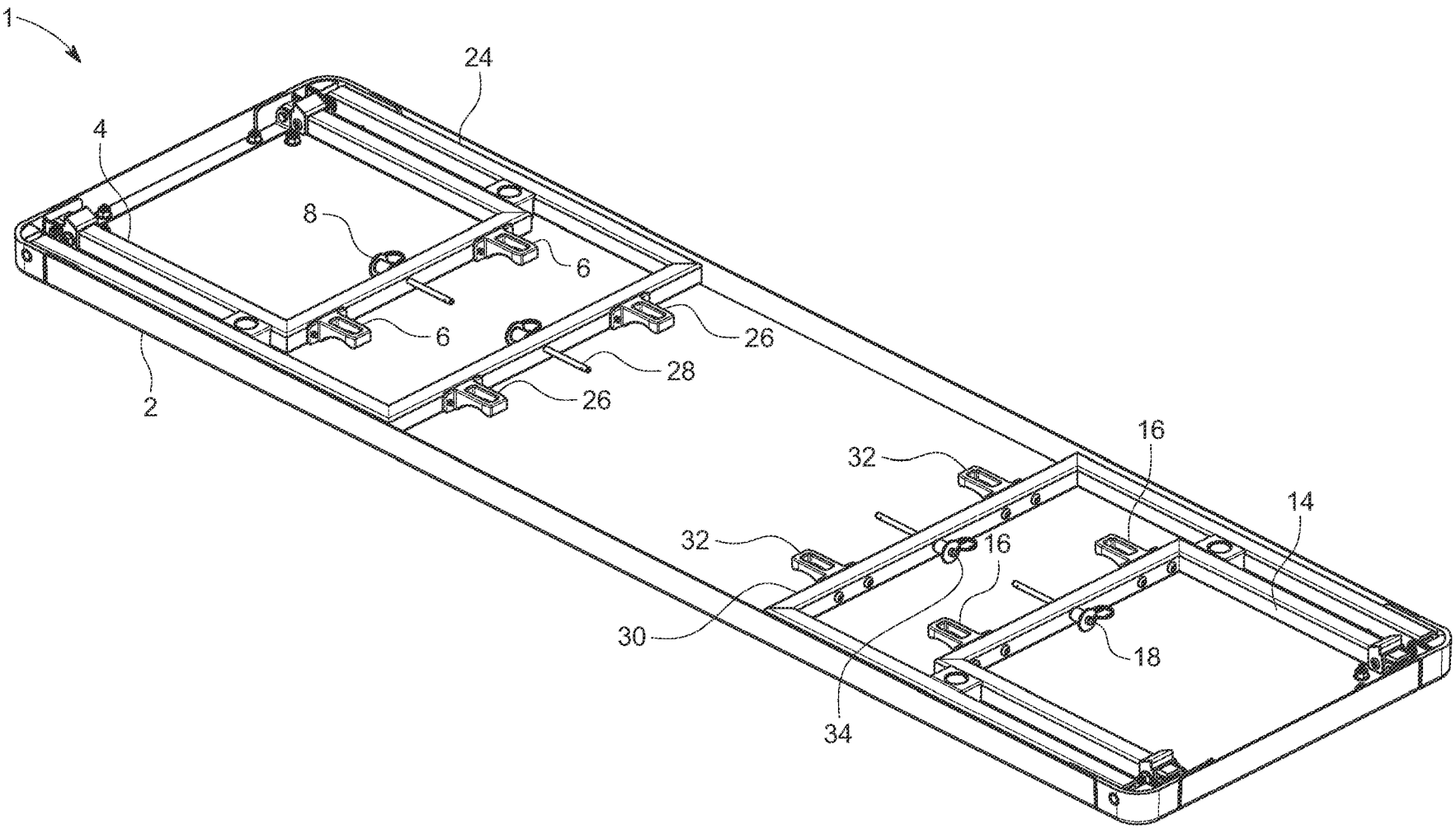
FIG. 4 shows a bottom prospective view of an exemplary sliding bed table in stored position in accordance with one or more embodiments of the present invention.

Sliding bed table 1 may either have two or more pairs of legs at different heights, may have one pair of legs with adjustable height, or may have only one pair of legs at a fixed height, as mentioned previously. The ability to change the height of sliding table 1 may allow it to be used as either a tray table positioned close to a person's lap or as a storage shelf positioned at a sufficient distance above a person, such that a person may sleep under it. FIG. 3 shows a comparative, front prospective view of sliding table 1 with its shorter legs for tray table use, leg 4 with feet 6 and leg 14 with feet 16, versus its taller legs for storage shelf use, leg 24 with feet 26 and leg 30 with feet 32. Both pairs of legs may be hingedly connected to a bottom surface of tabletop 2, as shown in FIG. 4, in their folded positions. Legs 4, 14, 24, and 30 may each be U-shaped legs that are hingedly connected to a bottom surface of tabletop 2 at or near the top ends of the "U" shape, as shown in FIG. 4. Legs 4, 14, 24, and 30 may alternatively each be a single wide leg, may each be made of two or more smaller legs (e.g., for a total of 4 or more legs, with one close to each corner of sliding bed table 1), or may have any typical table leg configuration that may be hingedly connected to tabletop 2. As shown in FIG. 4, shorter leg 4 with feet 6 and pin 8 may be nested inside the bounds of longer leg 24 with feet 26 and pin 28 and shorter leg 14 with feet 16 and pin 18 may be nested inside the bounds of longer leg 30 with feet 32 and pin 34. Either leg 4 with feet 6 may latch with pin 8 or leg 24 with feet 26 may latch with pin 28 to slider 10 on rail 12, examples of which were previously shown in FIGS. 1 and 2. Similarly, either leg 14 with feet 16 may latch with pin 18 or leg 30 with feet 32 may latch with pin 34 to slider 20 on rail 22, examples of which were previously shown in FIGS. 1 and 2. Sliding table 1 may be stored, as shown in FIG. 4, with both pairs of legs folded against a bottom surface of tabletop 2. Or sliding table 1 may be used with one pair of legs unfolded, while the other pair of legs remains in a folded position. If sliding table 1 is positioned at a tray table height (i.e., a shorter height above a person's lap) using legs 4 and 14, to transition it to a shelf height (i.e., a taller height positioned to allow a person to comfortably sleep below it), pins 8 and 18 may be disconnected or disengaged, feet 6 and 16 may then be lifted out of the notches, holes, or grooves in sliders 10 and 20, respectively, as previously shown in FIG. 1. Legs 4 and 14 may then be folded toward tabletop 2 until they rest relatively flat with a bottom surface of tabletop 2 (as shown in FIG. 4), legs 24 and 30 may then be unfolded away from tabletop 2, feet 26 and 32 may be placed into notches in sliders 10 and 20 (similar to examples shown previously in FIGS. 1 and 2), respectively, and lastly pins 28 and 34 may be connected or engaged to securely latch the table to sliders 10 and 20, respectively, allowing sliding table 1 to slide along rails 12 and 22. Alternatively, if the feet or legs of sliding table 1 have components such as wheels (e.g., vertical or horizontal wheels) or other sliding components or components capable of sliding that can fit into guides such as tracks, trenches, grooves, and/or slots, the guides may be configured such that at certain locations, the opening in the guides may wide enough to accept or release the sliding components, however elsewhere along the guided path, the opening is narrower causing sliding bed table 1, through its sliding components, to be held captive, helping to prevent accidentally tipping of the table along those portions of the guides where the opening is narrow (e.g., similar to how a "key-hole" shaped opening may, at a certain location where the opening may be wider, allow for a wider portion of a component, such as a screw head, to be inserted and when the component is moved or slid to the narrow portion of the opening, the wider component is held captive until moved back to the wider portion of the opening).

Legs 4, 14, 24, and/or 30 may also contain stoppers or bumpers near the tops of the legs, as shown on legs 4 and 14 in FIGS. 3 and 4. These stoppers may or may not be necessary to limit the extension of the legs to a maximum angle (which may be different for different length legs) as they are unfolded. If the legs do not contain these stoppers, as shown on legs 24 and 30 in FIGS. 3 and 4, the edges of tabletop 2 may limit their extension to a maximum angle. This angle may be greater than 90 degrees relative to a bottom surface of tabletop 2, as shown in FIG. 3 which may allow the legs to slant toward the tabletop and/or middle of the mattress, which may aid in avoiding camper walls and/or objects on camper walls, as previously mentioned. Other mechanisms besides stoppers, bumpers, and table edges may be used to limit or adjust the extension of table legs, such as locking hinges, locking pins, or other components. These mechanisms (i.e., stoppers, bumpers, table edges, locking hinges, locking pins or other mechanisms) may also be configured to limit the angle of the unfolded legs to 90 degrees, about 90 degrees, or slightly more or less than 90 degrees, or adjustable to various angles, which may allow the table to be configured to be as wide or wider than the mattress below it, if space around the mattress permits that configuration.

Sliding bed table 1, comprised of tabletop 2; foldable legs 4, 14, 24, and 30, which may be slanted inward when unfolded, toward the center of the table or toward the center of a mattress over which the table may be positioned for use with feet 6, 16, 26, and 32, respectively, and secured with pins 8, 18, 28 and 34, respectively; and sliders 10 and 20 that attach to rails 12 and 22, respectively, may provide a secure surface that may be used as either a table, positioned just above a person's lap while a person is seated on a mattress below it, or as a storage shelf, positioned a comfortable distance above a person laying below it. Sliding table 1, by use of sliders on rails, may be secured in such a manner that it may not accidentally be tipped over during use or while repositioning it for various purposes. And sliding table 1 may be separable into a tabletop with legs that may be folded for storage and sliders on rails that may remain in place during storage and when not in use. Alternatively, a sliding mechanism may be a permanent or semi-permanent part of the leg assemblies of sliding table 1 (e.g., wheels, ball bearings, or some other rolling or non-rolling sliding mechanism attached directly to the legs instead of feet that are inserted into a slider), that may be inserted into, onto, or otherwise attached to the rails and capable of sliding along the rails, in which case sliding table 1 may be separable into the tabletop with legs that have attached sliding mechanisms and can fold for storage and the rails which may remain fixed in place. Or if, instead of rails, other guides such as tracks, trenches, groves, or slots are used, those components may remain in place when sliding table 1 is stored or may be permanent and/or integrated portions of the floor or platform which a mattress is placed on. Sliding table 1 may provide a work surface, dining table, storage shelf, seating surface, or other flat surface that may increase the functionality and usability of campers, particularly those with limited space.

Figure 5:
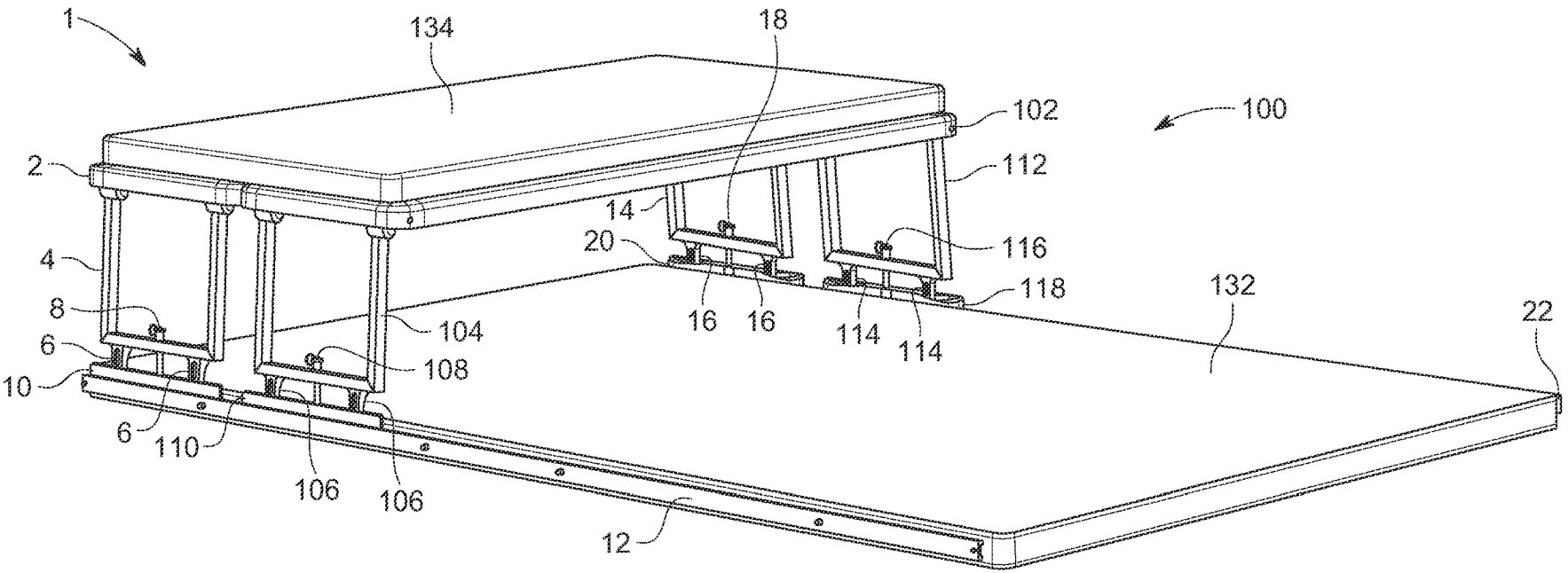
FIG. 5 shows a prospective view of two exemplary sliding bed tables at tray table height positioned next to each other above one mattress while supporting another mattress in accordance with one or more embodiments of the present invention.
Figure 6:
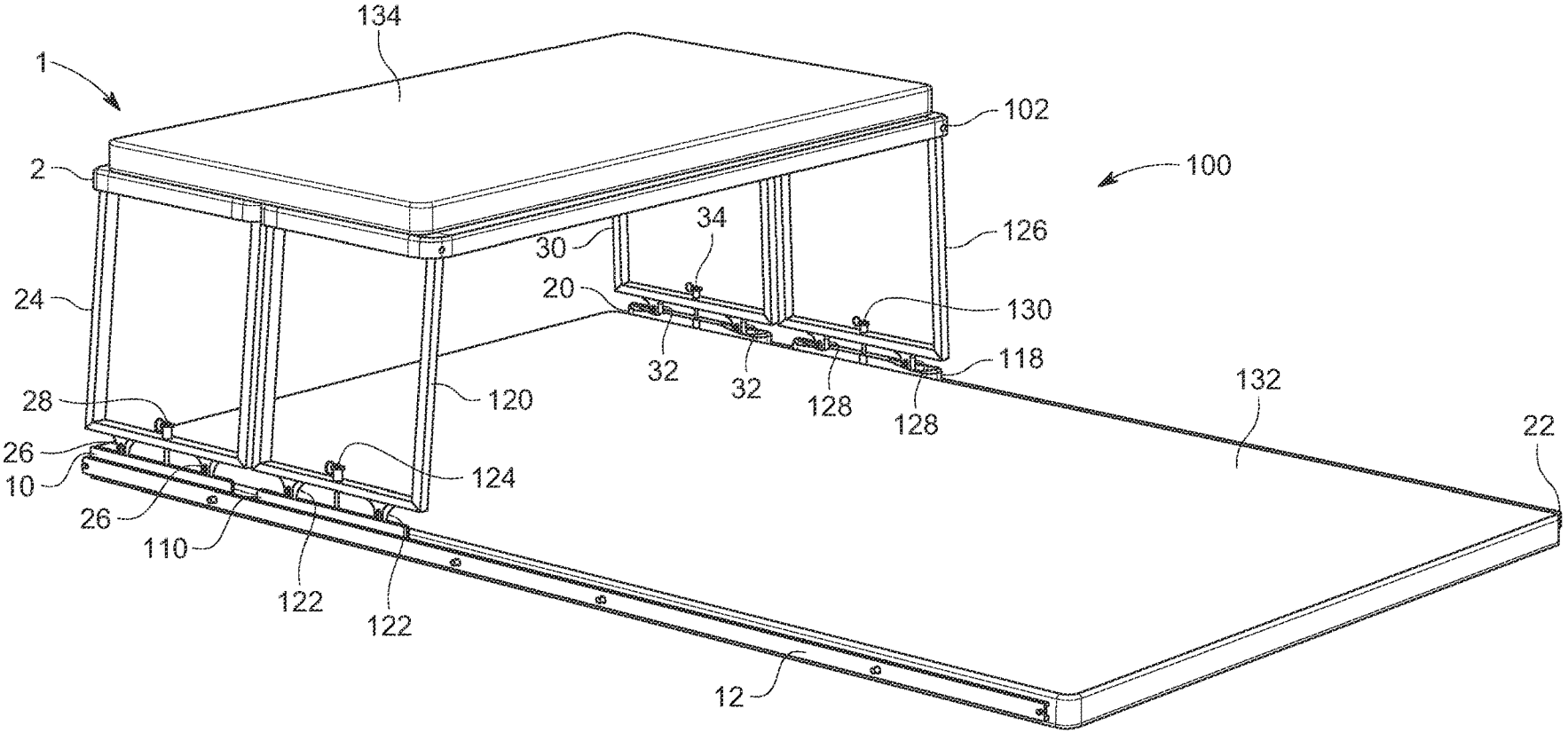
FIG. 6 shows a prospective view of two exemplary sliding bed tables at shelf height positioned next to each other above one mattress while supporting another mattress in accordance with one or more embodiments of the present invention.

Sliding bed table 100, which may be identical to sliding bed table 1 or may contain components similar to sliding table 1, may be positioned adjacent to sliding bed table 1 for use as a mattress platform to support a second mattress, as shown in FIGS. 5 and 6. Sliding bed table 100 may be identical to sliding bed table 1, except that it may not have its own pair of rails and may be placed on rails 12 and 22 of sliding bed table 1, as shown in FIGS. 5 and 6. Or it may be placed on other guides if rails 12 and 22 are instead tracks, trenches, groves, slots, or other guided pathways. Sliding bed table 100 may be placed adjacent to sliding bed table 1 such that a smaller mattress (e.g., a standard-size Crib mattress which may be about 28 inches wide by about 52 inches long, give or take a few inches; Small Single which may be about 30 inches wide by about 75 inches long, give or take a few inches; or other standard or non-standard sized mattress) may be placed on them and span both tables as shown in FIGS. 5 and 6, depending on how wide the sliding bed tables are configured to be which may depend on what size mattress the sliding bed tables are positioned over. Sliding bed table 100 may positioned at tray table height or at a taller, shelf height. Two sliding tables (i.e., sliding table 1 and sliding table 100) placed next to each other at tray table height may, together, create a table surface that is twice as deep as one sliding bed table, providing a deeper surface to work, eat, play, and/or place a smaller mattress on them (e.g., a small mattress placed across the tables, whose length is the same as or slightly less than the width of a main mattress placed below the tables). Alternatively, two sliding bed tables (e.g., sliding table 1 and sliding table 100) placed next to each other at shelf height may, together, create a shelf surface that is twice as deep as one sliding bed table, providing a deeper surface for storage and/or to place a smaller mattress on them (e.g., a small mattress placed across the tables, whose length is the same as or slightly less than the width of a main mattress placed below the tables) and may allow enough height below the tables for one or more people to comfortably sleep below the two sliding bed tables. In such a configuration, one or more people may be able to sleep on a main mattress below while another person (e.g., a child) may be able to sleep above, increasing the number of sleeping occupants a camper may be able to accommodate. Two sliding bed tables may also be placed at different heights adjacent to or apart from each other for different purposes. For example, one sliding bed table may be used as a tray table while another is used as a storage shelf or two sliding bed tables may be used together with one positioned as a bench, at a lower height, while the other is positioned as a table, at a taller height. Additional sliding bed tables may be added to increase the table, storage, sitting, or sleeping areas (e.g., additional tables and/or sliders may be added to the rails or other guides, limited only by the available length of the rails or other guides). If desirable, two sliding bed tables may be fastened (e.g., by straps, wings nuts, screws, magnets, clamps, or some other fastening mechanism, so that the two tables may be moved together or secured together so that they do not accidentally separate.

FIG. 5 shows two sliding bed tables positioned at tray table height, adjacent to each other, for use as a mattress platform. As shown in FIG. 5, sliding bed table 1 with tabletop 2 which has leg 4 with feet 6 and pin 8 inserted into and latched to slider 10 which is attached to rail 12 and leg 14 with feet 16 and pin 18 inserted into and latched to slider 20 which is attached to rail 22 may be positioned above mattress 132 and adjacent to sliding bed table 100 with tabletop 102 which has leg 104 with feet 106 and pin 108 inserted into and latched to slider 110 which is also attached to rail 12 and leg 112 with feet 114 and pin 116 inserted into and latched to slider 118 which is also attached to rail 22, such that both sliding bed tables may, together, form an elevated platform to support mattress 134. Mattress 132 may be a standard sized mattress (e.g., a Full, Queen, King or other standard sized mattress) and mattress 134 may be a smaller mattress that may be as long or almost as long as mattress 132 is wide. For example, if mattress 132 is a standard-size Full mattress it may be about 54 inches wide, give or take a few inches, and if sliding bed tables 1 and 100 configured to be placed above a Full mattress with legs 4 and 14 and legs 104 and 112, respectively, positioned in such a way that they slant toward the center of the mattress and/or tabletops, tabletops 2 and 102, respectively, may be slightly less than 54 inches wide (e.g., 52 inches wide, give or take a few inches) in which case, mattress 134 may be configured to be a standard-size Crib mattress, which may be about 52 inches long, give or take a few inches, and may be placed on the two sliding bed tables, forming an elevated bed (e.g., a small bed for a small child). If mattress 134 is a standard-size Crib mattress, it may be about 28 inches wide, give or take a few inches, and if tabletops 2 and 102 are about the typical depth of many tray tables, which may be about 14 to 16 inches deep, give or take a few inches, two sliding bed tables, placed adjacent to each other, may be deep enough to accommodate the width of mattress 134. As another example, if mattress 132 is configured to be a standard-size King mattress, which may be about 76 inches wide, give or take a few inches, and if sliding bed tables 1 and 100 are similarly configured to be placed above a King mattress, tabletops 2 and 102 may each be wide enough to accommodate mattress 134 if it is configured to be a standard-size Small Single mattress which may be about 75 inches long. In this configuration, the length of mattress 134 placed above sliding bed tables 1 and 100, may be long enough to accommodate a larger child or an adult. As mentioned previously, if tabletops 2 and 102 are about the typical depth of many tray tables they may be about 14 to 16 inches deep, give or take a few inches, in which case their combined depths may be wide enough to accommodate a standard-size Small Single mattress which may be about 30 inches wide, give or take a few inches. As shown in FIG. 5, with sliding bed tables 1 and 100 placed at tray table height with legs 4 and 14, and legs 104 and 112, respectively, the elevated bed may or may not be tall enough for a person to sleep below it.

FIG. 6 shows two sliding bed tables positioned at shelf height, adjacent to each other, for use as a mattress platform. As shown in FIG. 6, sliding bed table 1 with tabletop 2 which has leg 24 with feet 26 and pin 28 inserted into and latched to slider 10 which is attached to rail 12 and leg 30 with feet 32 and pin 34 inserted into and latched to slider 20 which is attached to rail 22 may be positioned above mattress 132 and adjacent to sliding bed table 100 with tabletop 102 which has leg 120 with feet 122 and pin 124 inserted into and latched to slider 110 which is also attached to rail 12 and leg 126 with feet 128 and pin 130 inserted into and latched to slider 118 which is also attached to rail 22, such that both sliding bed tables may, together, form an elevated platform for mattress 134. As mentioned previously and as shown in FIGS. 5 and 6, mattress 132 may be a standard sized mattress (e.g., a Full, Queen, King or other standard sized mattress) or non-standard sized and mattress 134 may be a smaller (standard or non-standard sized) mattress that may be as long or almost as long as mattress 132 is wide. For example, and as mentioned earlier, if mattress 132 is a standard size Full mattress it may be about 54 inches wide, give or take a few inches, and if sliding bed tables 1 and 100 configured to be placed above a Full mattress with legs 24 and 30 and legs 120 and 126, respectively, positioned in such a way that they slant toward the center of the mattress and/or tabletops, tabletops 2 and 102, respectively, may be slightly less than 54 inches wide (e.g., 52 inches wide, give or take a few inches) in which case, a standard-size Crib mattress, which may be about 52 inches long, give or take a few inches, may be placed on the two sliding bed tables, forming an elevated bed (e.g., a small bed for a small child). If mattress 134 is a standard-size Crib mattress, which may be about 28 inches wide, give or take a few inches, and if tabletops 2 and 102 are about the typical depth of many tray tables, which may be about 14 to 16 inches deep, give or take a few inches, sliding bed tables 1 and 100, placed adjacent to each other, may be deep enough to accommodate the width of mattress 134. As another example and as previously mentioned, if mattress 132 is configured to be a standard-size King mattress, which may be about 76 inches long, give or take a few inches, and if sliding bed tables 1 and 100 are similarly configured to be placed above a King mattress, tabletops 2 and 102 may each be wide enough to accommodate mattress 134 if it is configured to be a standard-size Small Single mattress, which may be about 75 inches long. In this configuration and as previously mentioned, mattress 134 placed above sliding bed tables 1 and 100, may be long enough to accommodate a larger child or an adult. As shown in FIG. 6, with sliding bed tables 1 and 100 placed at shelf height, with legs 24 and 30, and legs 120 and 126, respectively, the elevated bed may be tall enough for a person to sleep below it, increasing the number of occupants the camper that contains sliding bed tables 1 and 100 may be able to comfortably sleep.

Mattresses 132 and 134 may each be comprised of foam, springs, fabric, and/or other material, and/or some combination of materials typically used in mattress construction. As previously mentioned, mattress 132 may be configured to be certain standard sizes with widths that correspond to the length of other standard-sized mattresses that may be used for mattress 134 (e.g., if mattress 132 is a Full-size mattress, mattress 134 may be a Crib-size mattress; or if mattress 132 is a King-size mattress, mattress 134 may be a Small Single-size mattress). Alternatively, mattress 132 may be a custom size or other standard or non-standard size and mattress 134 may be configured to be a custom size or other standard or non-standard size mattress that may be as long as mattress 132 is wide or shorter. As previously mentioned, mattress 132 may rest on top of a mattress platform or may be placed directly on the floor of a camper, for example. Mattress 132 may also be placed on any suitable surface that can accommodate a mattress and that rails 12 and 22 may be fixed to or that may have other types of guides, such as tracks, trenches, grooves, slots or other guides that maybe fixed to or carved, cut, or molded into the surface that hold mattress 132. Mattress 132 may simply be placed on a suitable surface, may be held in place by straps, or may be bound by other certain objects (e.g., a boundary or fence formed around the mattress). Similarly, mattress 134 may simply be placed on sliding bed tables 1 and 100, may be held in place on sliding bed tables 1 and 100 by straps (e.g., straps attached temporarily or permanently to mattress 134 that may be placed around or through tabletops 2 and 102 of sliding bed tables 1 and 100, respectively), or may be held in place by a boundary (e.g., a boundary formed by one or more camper walls and/or one or more fences temporarily, semi-permanently, or permanently attached to tabletops 2 or 102). A boundary, if used, may also aid in preventing a child or adult from accidentally rolling off the elevated bed formed by placing sliding bed tables 1 and 100 adjacent to each other with mattress 134 placed on top of them.

What is claimed is:

1. A sliding bed table comprising:

a tabletop comprising a top surface and a bottom surface;

a first pair of legs, each of the first pair of legs being U-shaped and hinged near each longitudinal end of the bottom surface of the tabletop to form a rectangular frame;

a second pair of legs, each of the second pair of legs being U-shaped and hinged near each longitudinal end of the bottom surface of the tabletop to form a rectangular frame; and two guides, wherein each of the first pair of legs is transitionable between a first unfolded configuration and a first folded configuration, wherein in the first unfolded configuration, each of the first pair of legs is unfolded until configured to be connected to each of the two guides, respectively, wherein in the first folded configuration, each of the first pair of legs is folded toward the bottom surface of the tabletop until resting relatively flat with the bottom surface of the tabletop, wherein each of the second pair of legs is transitionable between a second unfolded configuration and a second folded configuration, wherein in the second unfolded configuration, each of the second pair of legs is unfolded until configured to be connected to each of the two guides, respectively, and wherein in the second folded configuration, each of the second pair of legs is folded toward the bottom surface of the tabletop until resting relatively flat with the bottom surface of the tabletop.

2. The sliding bed table of claim 1, wherein each of the first pair of legs is height-adjustable.

3. The sliding bed table of claim 1, further having indentations along the bottom surface configured to fully accommodate the first pair of legs in the first folded configuration.

4. The sliding bed table of claim 1, wherein in the first unfolded configuration, each of the first pair of legs is unfolded to form an angle of about 90 degrees with the bottom surface of the tabletop.

5. The sliding bed table of claim 1, wherein in the first unfolded configuration, each of the first pair of legs is slanted inward or outward toward the bottom surface of the tabletop.

6. The sliding bed table of claim 1, further comprising two sliders, each of which being associated with each of the two guides, respectively, wherein each of the first pair of legs is configured to be connected to the respective slider that is configured to slidably move on each of the two guides, respectively.

7. The sliding bed table of claim 6, wherein each of the first pair of legs comprises a connector that is configured to be received by the respective slider.

8. The sliding bed table of claim 7, wherein the connector is configured to be secured and detached by a mechanism of the respective slider.

9. The sliding bed table of claim 7, wherein the connector is a pin and/or protrusion from the first pair of legs.

10. The sliding bed table of claim 1, wherein each of the second pair of legs is height-adjustable.

11. The sliding bed table of claim 1, further having indentations along the bottom surface configured to fully accommodate the second pair of legs in the second folded configuration.

12. The sliding bed table of claim 1, wherein in the second unfolded configuration, each of the second pair of legs is unfolded to form an angle of about 90 degrees with the bottom surface of the tabletop.

13. The sliding bed table of claim 1, wherein in the second unfolded configuration, each of the second pair of legs is slanted inward or outward toward the bottom surface of the tabletop.

14. The sliding bed table of claim 1, further comprising two sliders, each of which being associated with each of the two guides, respectively, wherein each of the second pair of legs is configured to be connected to the respective slider that is configured to slidably move on each of the two guides, respectively.

15. The sliding bed table of claim 14, wherein each of the second pair of legs comprises a connector that is configured to be received by the respective slider.

16. The sliding bed table of claim 15, wherein the connector is configured to be secured and detached by a mechanism of the respective slider.

17. The sliding bed table of claim 1, wherein each of the first pair of legs is positioned adjacent to the respective second pair of legs.

18. The sliding bed table of claim 1, wherein each of the first pair of legs in the first folded configuration are nested inside the respective second pair of legs in the second folded configuration.

19. A sliding bed table comprising:

a tabletop comprising a top surface and a bottom surface;

a first pair of legs, each of the first pair of legs being U-shaped hinged near each longitudinal end of the bottom surface of the tabletop to form a rectangular frame; and two guides, wherein each of the first pair of legs is transitionable between a first unfolded configuration and a first folded configuration, wherein in the first unfolded configuration, each of the first pair of legs is unfolded until configured to be connected to each of the two guides, respectively, wherein in the first folded configuration, each of the first pair of legs is folded toward the bottom surface of the tabletop until resting relatively flat with the bottom surface of the tabletop, and wherein in the first unfolded configuration, each of the first pair of legs is slanted inward or outward toward the bottom surface of the tabletop.

20. A sliding bed table comprising:

a tabletop comprising a top surface and a bottom surface;

a first pair of legs, each of the first pair of legs being U-shaped and hinged near each longitudinal end of the bottom surface of the tabletop to form a rectangular frame; and two guides connected to a camper, wherein each of the first pair of legs is transitionable between a first unfolded configuration and a first folded configuration, wherein in the first unfolded configuration, each of the first pair of legs is unfolded until configured to be connected to each of the two guides, respectively, and wherein in the first folded configuration, each of the first pair of legs is folded toward the bottom surface of the tabletop until resting relatively flat with the bottom surface of the tabletop.

* * * * *